US007954811B2

(12) United States Patent
Ishikawa et al.

(10) Patent No.: US 7,954,811 B2
(45) Date of Patent: Jun. 7, 2011

(54) SHEET PROCESSING APPARATUS, METHOD OF CONTROLLING THE SAME, AND IMAGE FORMING APPARATUS

(75) Inventors: Naoki Ishikawa, Kashiwa (JP); Hitoshi Kato, Toride (JP)

(73) Assignee: Canon Kabushiki Kaisha (JP)

( * ) Notice: Subject to any disclaimer, the term of this patent is extended or adjusted under 35 U.S.C. 154(b) by 83 days.

(21) Appl. No.: 12/561,564

(22) Filed: Sep. 17, 2009

(65) Prior Publication Data

US 2010/0072693 A1 Mar. 25, 2010

(30) Foreign Application Priority Data

Sep. 25, 2008 (JP) ..... 2008-245984

(51) Int. Cl.
*B65H 9/04* (2006.01)

(52) U.S. Cl. ..... 271/245; 271/236; 270/58.17

(58) Field of Classification Search ..... 271/245, 271/246, 233, 236, 239; 270/58.07, 58.12, 270/58.17
See application file for complete search history.

(56) References Cited

U.S. PATENT DOCUMENTS

| | | | | |
|---|---|---|---|---|
| 5,639,078 | A * | 6/1997 | Mandel et al. | 270/58.12 |
| 5,873,664 | A * | 2/1999 | Umemo | 400/579 |
| 7,445,208 | B2 * | 11/2008 | Onodera | 271/239 |
| 7,520,497 | B2 * | 4/2009 | Moriyama et al. | 270/58.07 |
| 7,766,326 | B2 * | 8/2010 | Obuchi et al. | 271/228 |
| 7,845,626 | B2 * | 12/2010 | Iguchi et al. | 270/58.07 |
| 2005/0159287 | A1 | 7/2005 | Kaneko et al. | |
| 2006/0120783 | A1 * | 6/2006 | Tokita et al. | 399/407 |
| 2007/0023995 | A1 * | 2/2007 | Onodera | 271/226 |
| 2007/0029719 | A1 | 2/2007 | Nagasawa et al. | |
| 2007/0273091 | A1 * | 11/2007 | Kamiya et al. | 271/233 |
| 2009/0110516 | A1 | 4/2009 | Hasegawa et al. | |
| 2011/0012298 | A1 * | 1/2011 | Taguchi et al. | 270/52.04 |

FOREIGN PATENT DOCUMENTS

| | | | |
|---|---|---|---|
| EP | 1 650 145 | A2 | 4/2006 |
| EP | 1 749 746 | A2 | 2/2007 |
| EP | 1 908 717 | A1 | 4/2008 |
| JP | 2003-226464 | A | 8/2003 |

OTHER PUBLICATIONS

Extended European Search Report issued in corresponding European Patent Application No. 09171382.6 dated Jun. 23, 2010.

* cited by examiner

*Primary Examiner* — Kaitlin S Joerger
(74) *Attorney, Agent, or Firm* — Rossi, Kimms & McDowell LLP

(57) ABSTRACT

A sheet processing apparatus which is cable of moving a sheet without applying extra load to the movement of the sheet in the case of laterally moving the sheet for sorting after completion of punching of holes in the sheet. A sheet is conveyed toward an abutment member. The sheet comes into abutment with the abutment member, whereby skew of the sheet is corrected. A punching unit punches holes in the sheet in abutment with the abutment member. A shift unit shifts the punched sheet that has been punched by the puncher in a direction intersecting with a conveying direction of the conveying unit. A controller causes the shift unit to start shifting the sheet in response to separate between the punched sheet and the abutment member.

12 Claims, 13 Drawing Sheets

SHEET PROCESSING APPARATUS, METHOD OF CONTROLLING THE SAME, AND IMAGE FORMING APPARATUS

BACKGROUND OF THE INVENTION

1. Field of the Invention

The present invention relates to a sheet processing apparatus for performing post-processing on sheets having images formed thereon, a method of controlling the sheet processing apparatus, and an image forming apparatus equipped with the sheet processing apparatus.

2. Description of the Related Art

In recent years, an image forming apparatus for forming images on sheets has been generally equipped with a sheet processing apparatus called a finisher. The finisher aligns the edges of sheets discharged from the image forming apparatus, using a sheet alignment device, and then carries out post-processing including punching for punching holes in each of the sheets, stapling sheets stacked in a bundle form into one bundle, sheet sorting, etc. The sheet processing apparatus for performing such post-processing is demanded to execute the post-processing, such as pinching and stapling, with high accuracy so as to enhance the quality of products.

For example, in the case of punching, it is required to highly accurately position holes to be punched, so as to prevent dislocation of holes. However, a sheet conveyed into a sheet processing apparatus from an image forming apparatus can be laterally displaced in a direction orthogonal to a sheet conveying direction or skewed. In order to punch holes in such a sheet with high accuracy, the lateral displacement or skew of the sheet is corrected before punching.

For example, there has been proposed a device configured to punch holes in a sheet after correcting displacement of the sheet and then offset the sheet for sorting after completion of the punching (see e.g. Japanese Patent Laid-Open Publication No. 2003-226464).

Further, there has been proposed a device configured to punch holes in a sheet after correcting skew of the sheet by bringing the sheet into abutment with an abutment member (see US Patent Publication No. 2007/0029719).

The sheet processing apparatus is further demanded to perform post-processing with high accuracy without reducing productivity. In other words, the sheet processing apparatus is demanded to perform post-processing with high accuracy and in a short time.

However, the conventional sheet processing apparatus suffers from the following problem: In the conventional sheet processing apparatus, the skewed side of a sheet is brought into abutment with the abutment member, whereby the skew of the sheet side is corrected. Then, punching is performed on the sheet held in abutment with the abutment member, and the punched sheet is shifted laterally for sorting in the direction orthogonal to the sheet conveying direction. In this case, the sheet is moved in a state held in contact with the abutment member, and hence a frictional force is generated between the sheet and the abutment member. As a consequence, extra load due to the frictional force is applied to a motor for offsetting sheets. To withstand the increased load, the motor requires an increased size, which results in an increase in the manufacturing costs of the sheet processing apparatus.

SUMMARY OF THE INVENTION

The present invention provides a sheet processing apparatus which is cable of moving a sheet without applying extra load to the movement of the sheet in the case of laterally moving the sheet for sorting after completion of punching of holes in the sheet, a method of controlling the sheet processing apparatus, and an image forming apparatus equipped with the sheet processing apparatus.

In a first aspect of the present invention, there is provided a sheet processing apparatus comprising an abutment member configured to correct skew of a side of a sheet, a conveying unit configured to convey the sheet toward the abutment member so as to bring the sheet into abutment with the abutment member, a puncher configured to punch holes in the sheet in abutment with the abutment member, a shift unit configured to shift the punched sheet that has been punched by the puncher in a direction intersecting with a conveying direction of the conveying unit, and a control unit configured to cause the shift unit to start shifting the sheet in response to separation between the punched sheet and the abutment member.

In a second aspect of the present invention, there is provided a method of controlling a sheet processing apparatus including a conveying unit configured to convey a sheet, an abutment member configured to correct skew of the sheet, a punching unit configured to punch holes in the sheet, and a shift unit configured to shift the punched sheet in a direction intersecting with a conveying direction, comprising causing the conveying unit to convey the sheet toward the abutment member and bring the sheet into abutment with the abutment member so as to correct skew of the sheet, causing the punching unit to punch holes in the sheet in abutment with the abutment member, and causing the shift unit to shift the punched sheet that has been punched by the puncher in the direction intersecting with the conveying direction of the conveying unit in response to separation between the punched sheet and the abutment member.

In a third aspect of the present invention, there is provided an image forming apparatus comprising an image forming unit configured to form an image on a sheet, and a sheet processing apparatus configured to perform post-processing on the sheet having the image formed thereon by the image forming unit, wherein the sheet processing apparatus comprises an abutment member configured to correct skew of a sheet, a conveying unit configured to convey the sheet toward the abutment member so as to bring the sheet into abutment with the abutment member, a puncher configured to punch holes in the sheet in abutment with the abutment member, a shift unit configured to shift the punched sheet that has been punched by the puncher in a direction intersecting with a conveying direction of the conveying unit, and a control unit configured to cause the shift unit to start shifting the sheet in response to separate between the punched sheet and the abutment member.

In a fourth aspect of the present invention, there is provided a sheet processing apparatus comprising an abutment member configured to correct skew of a side of a sheet, a conveying unit configured to convey the sheet toward the abutment member so as to bring the sheet into abutment with the abutment member, a puncher configured to punch holes in the sheet in abutment with the abutment member, a shift unit configured to shift the punched sheet that has been punched by the puncher in a direction intersecting with a conveying direction of the conveying unit, and a control unit configured to cause the shift unit to start shifting the sheet when a predetermined time period elapses after an operation for separating between the punched sheet and the abutment member is started.

According to the present invention, in the case of laterally moving a sheet for sorting after completion of punching of holes in the sheet, it is possible to move the sheet without applying extra load to the movement of the sheet. This eliminates the need to increase the size of a drive system for moving sheets for sorting.

The features and advantages of the invention will become more apparent from the following detailed description taken in conjunction with the accompanying drawings.

DETAILED DESCRIPTION OF THE EMBODIMENTS

The present invention will now be described in detail below with reference to the accompanying drawings showing embodiments thereof.

Figure 1:
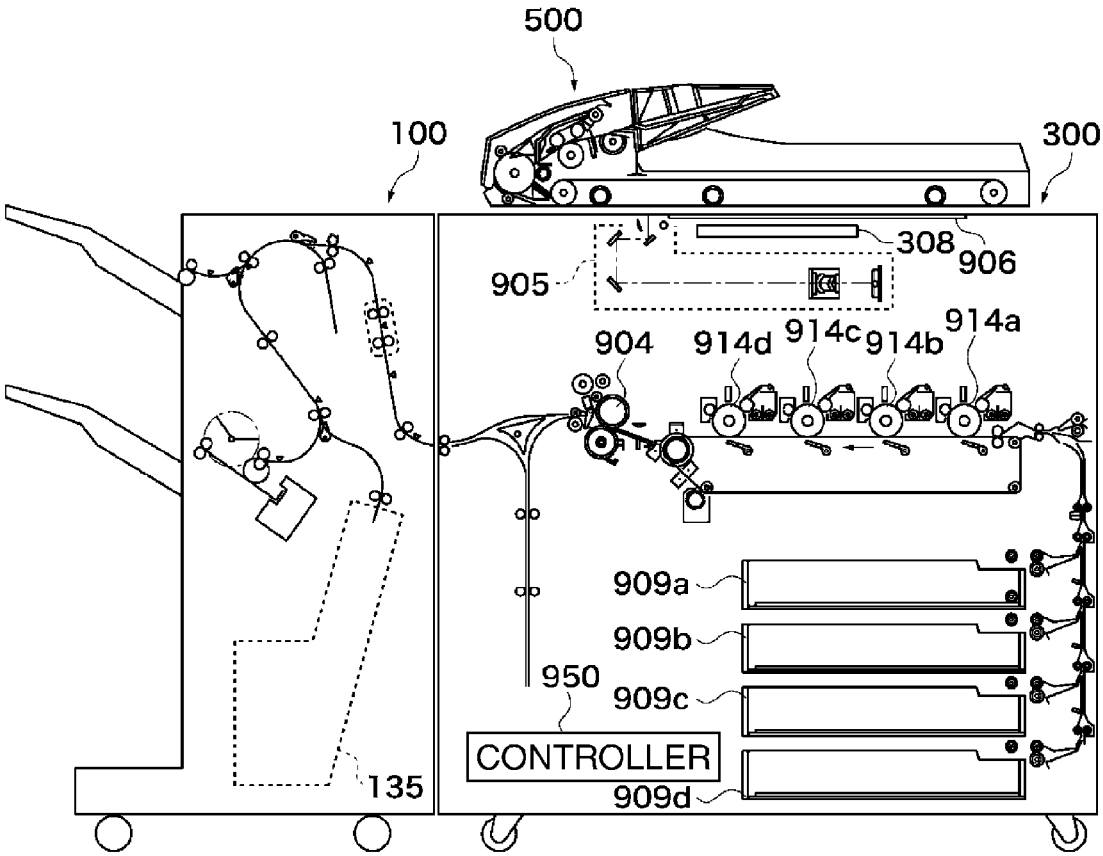
FIG. 1 is a schematic longitudinal cross-sectional view of an image forming apparatus equipped with a sheet processing apparatus according to a first embodiment of the present invention.

FIG. 1 is a schematic longitudinal cross-sectional view of an image forming apparatus equipped with a sheet processing apparatus according to a first embodiment of the present invention.

As shown in FIG. 1, the image forming apparatus of the present embodiment is comprised of a color copying machine (hereinafter referred to as "the copying machine") 300 and a sheet processing apparatus 100 which is connected to the copying machine 300. Here, the copying machine 300 includes a document feeder 500, a scanner 905, a plurality of cassettes 909*a* to 909*d*, a plurality of image forming units 914*a* to 914*d*, a fixing device 904, and a controller 950. The copying machine 300 has an console section 308. The console section 308 includes a plurality of keys for configuring various functions for image forming operation, and a display section for displaying information indicative of the configurations.

The document feeder 500 sequentially feeds set originals onto a platen glass 906. The scanner 905 reads an original fed onto the platen glass 906, and outputs image data of the original, which is obtained by the reading. The output image data is converted into image data of respective colors of yellow, magenta, cyan, and black.

Each of the image forming units 914*a* to 914*d* receives image data of an associated color, and forms a toner image of the associated color based on the input image data. The toner images formed by the respective image forming units 914*a* to 914*d* are transferred onto a sheet fed from one of the cassettes 909*a* to 909*d*, in superimposed relation. Thus, a full-color toner image is transferred on the sheet, and the sheet is conveyed to the fixing device 904.

The fixing device 904 heats and presses the sheet having the toner image transferred thereon, to thereby fix the toner image on the sheet. Thus, a full-color image is formed on the sheet, and the sheet is conveyed to the sheet processing apparatus 100.

The sheet processing apparatus 100 includes a saddle stitch processing unit (saddle processing unit) 135 and a side-stitching processing unit 136. Each of the saddle stitch processing unit 135 and the side-stitching processing unit 136 is capable of processing sheets discharged from the copying machine 300 online. The side-stitching processing unit 136 is capable of stacking the sheets as a bundle, and performing stapling on the sheet bundle using staples.

The controller 950 of the copying machine 300 controls not only the copying machine 300, but also the sheet processing apparatus 100.

The copying machine 300 can be used alone, and the sheet processing apparatus 100 is an optional device which is connected to the copying machine 300 as required. Alternatively, the image forming apparatus may integrally comprise the copying machine 300 and the sheet processing apparatus 100.

Figure 2:
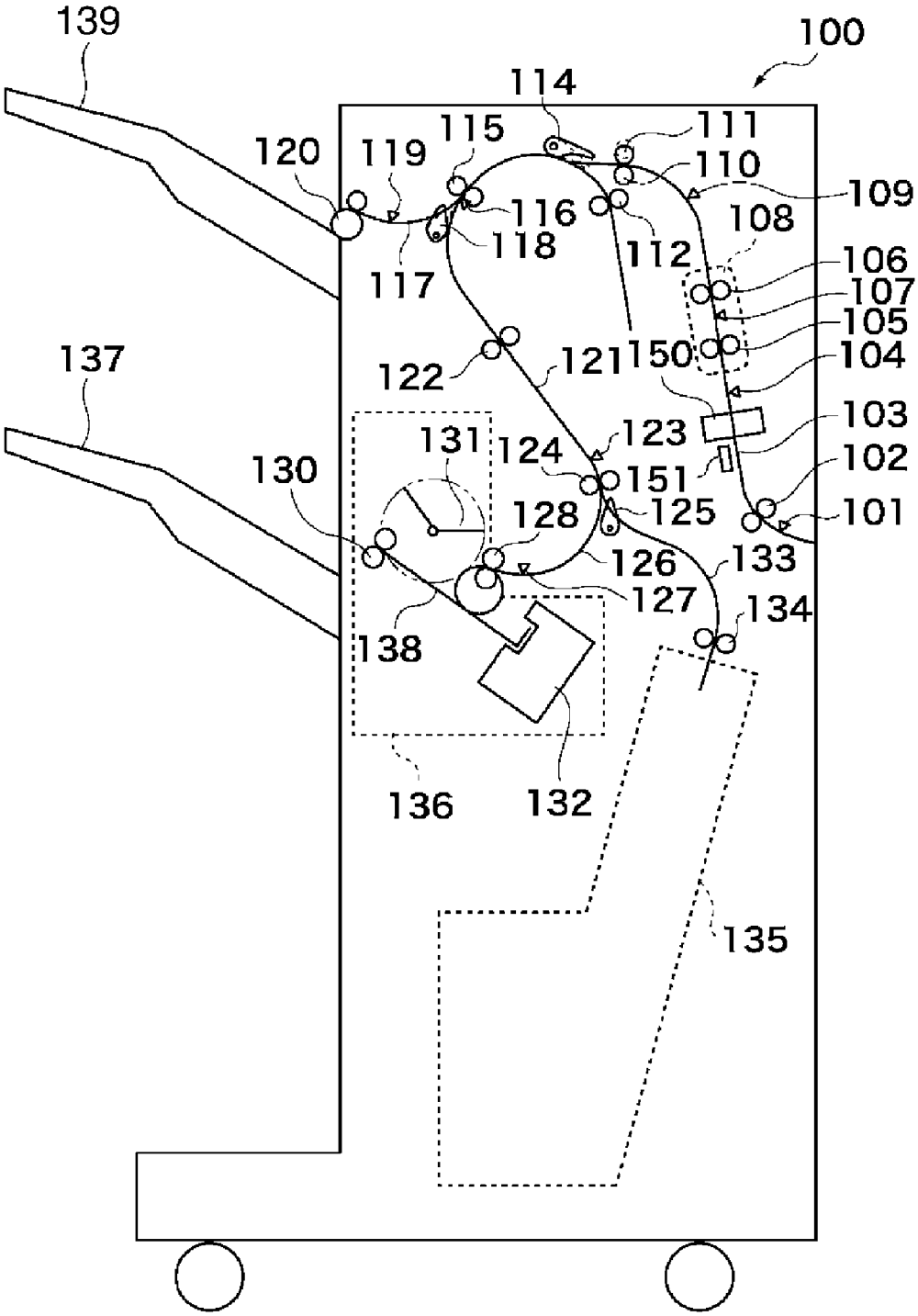
FIG. 2 is a schematic longitudinal cross-sectional view of essential parts of the sheet processing apparatus appearing in FIG. 1.

Next, a description will be given of the essential parts of the sheet processing apparatus 100 with reference to FIG. 2. FIG. 2 is a schematic longitudinal cross-sectional view of the essential parts of the sheet processing apparatus 100 in FIG. 1.

As shown in FIG. 2, the sheet processing apparatus 100 includes an inlet roller pair 102 which receives a sheet having an image formed thereon from the copying machine 300 and conveys the same toward a conveying path 103. An inlet sensor 101 is disposed at a location upstream of the inlet roller pair 102, and sheet receiving timing is detected based on an output from the inlet sensor 101.

At a location downstream of the inlet roller pair 102 of the conveying path 103, there are arranged an abutment member (stopper) 151, a punching unit 150, a shift unit 108, a conveying roller 110 and a separation roller 111, a flapper 114, and a buffer roller pair 115 in the mentioned order. Further, a lateral displacement sensor 104 is disposed in the vicinity of the inlet of the shift unit 108, and a buffer sensor 109 is disposed between the shift unit 108 and the conveying roller 110.

The abutment member 151 is moved, as described hereinafter, to its retreat position for retreat from the conveying path 103 or to its appearance position for appearance on the conveying path 103. By moving to its appearance position, the abutment member 151 functions as a member for correcting skew of the trailing end side of a sheet to be punched, by abutment with the trailing end side of the sheet. The construction and operation of the abutment member 151 will be described in detail hereinafter.

The punching unit 150 punches holes in sheets. The construction and operation of the punching unit 150 will also be described in detail hereinafter.

The lateral displacement sensor 104 detects an end of a sheet in a transverse direction orthogonal to the sheet conveying direction. An output from the lateral displacement sensor 104 is used to detect the amount of shift (lateral displacement) from a reference position (central position in the conveying path 103) in the transverse direction.

The shift unit 108 is provided with two shift roller pairs 105 and 106. The shift unit 108 is moved, with the shift roller pairs nipping a sheet, in the direction orthogonal to the conveying direction by a distance of travel that offsets a shift amount detected based on an output from the lateral displacement sensor 104. Thus, the sheet is returned to the reference position. The construction of the shift unit 108 will be described in detail hereinafter. A sheet sensor 107 is disposed between the shift roller pairs 105 and 106.

The conveying roller 110 and the separation roller 111 are configured such that they can come into contact with each other and separate from each other. The conveying roller 110 and the separation roller 111 convey a sheet having passed through the shift unit 108 toward the buffer roller pair 115 via the flapper 114.

The sheet conveyed by the buffer roller pair 115 is guided into an upper conveying path 117 or a bundle conveying path 121 via a flapper 118. The sheet conveyed into the conveying path 117 is discharged on an upper tray 139 by an upper discharge roller pair 120. A sheet sensor 119 for detecting a sheet jam is disposed on the upper conveying path 117.

The sheet guided into the bundle conveying path 121 is conveyed by a buffer roller pair 122 and a bundle conveying roller pair 124, and is guided into a saddle path 133 or a lower conveying path 126 by a flapper 125.

The sheet guided into the saddle path 133 is conveyed to the saddle stitch processing unit 135 by a saddle inlet roller pair 134. The construction of the saddle stitch processing unit 135 is well known, and hence a description thereof is omitted.

The sheet guided into the lower conveying path 126 is conveyed through a lower discharge roller pair 128 to the side-stitching processing unit 136. The side-stitching processing unit 136 has an intermediate processing tray 138. Sheets sequentially discharged on the intermediate processing tray 138 by the lower discharge roller pair 128 are stacked one upon another to form a bundle. At this time, alignment processing for aligning ends of the respective stacked sheets is performed by the operations of a bundle discharge roller pair 130, a paddle 131, and so forth. Then, when a number of sheets required to form one set of copies are stacked as a bundle on the intermediate processing tray 138, the sheets are stapled into one bundle by a stapler 132, as required. The sheet bundle stapled by the stapler 132 or the unstapled sheet bundle is discharged on a lower discharge tray 137 by the bundle discharge roller pair 130.

Next, the construction of the shift unit 108 will be described with reference to FIGS. 3 and 4.

Figure 3:
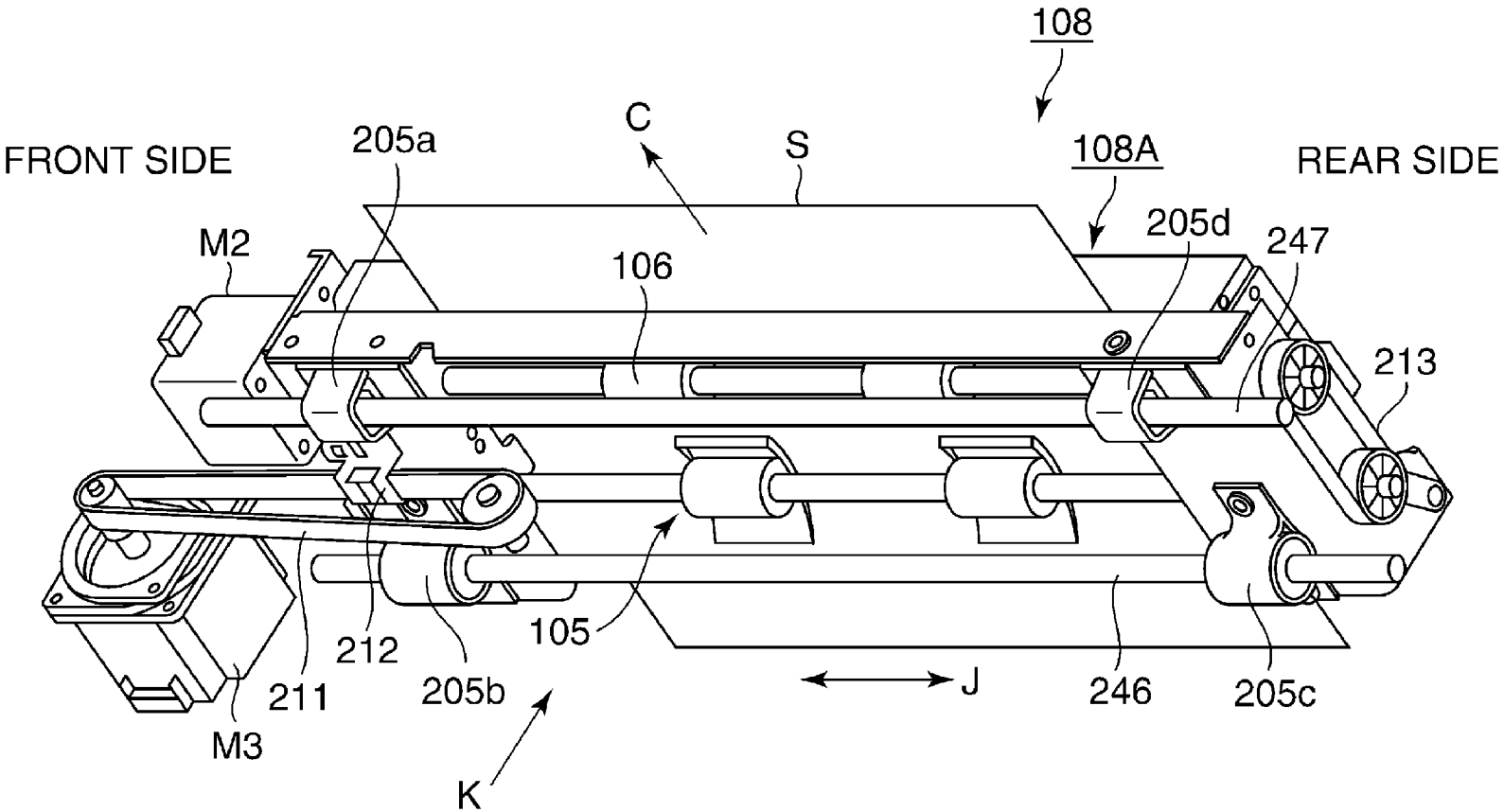
FIG. 3 is a perspective view of the appearance of a shift unit appearing in FIG. 2.

FIG. 3 is a perspective view of the appearance of the shift unit 108 appearing in FIG. 2. FIG. 4 is a view of the shift unit 108 as viewed in a direction indicated by an arrow K in FIG. 3. "Front Side" indicated in FIG. 3 or 4 corresponds to the front (side toward the viewer, as viewed in FIG. 1) of the sheet processing apparatus 100, and "Rear Side" indicated in the same corresponds to the rear (side remote from the viewer, as viewed in FIG. 1) of the sheet processing apparatus 100.

Figure 4:
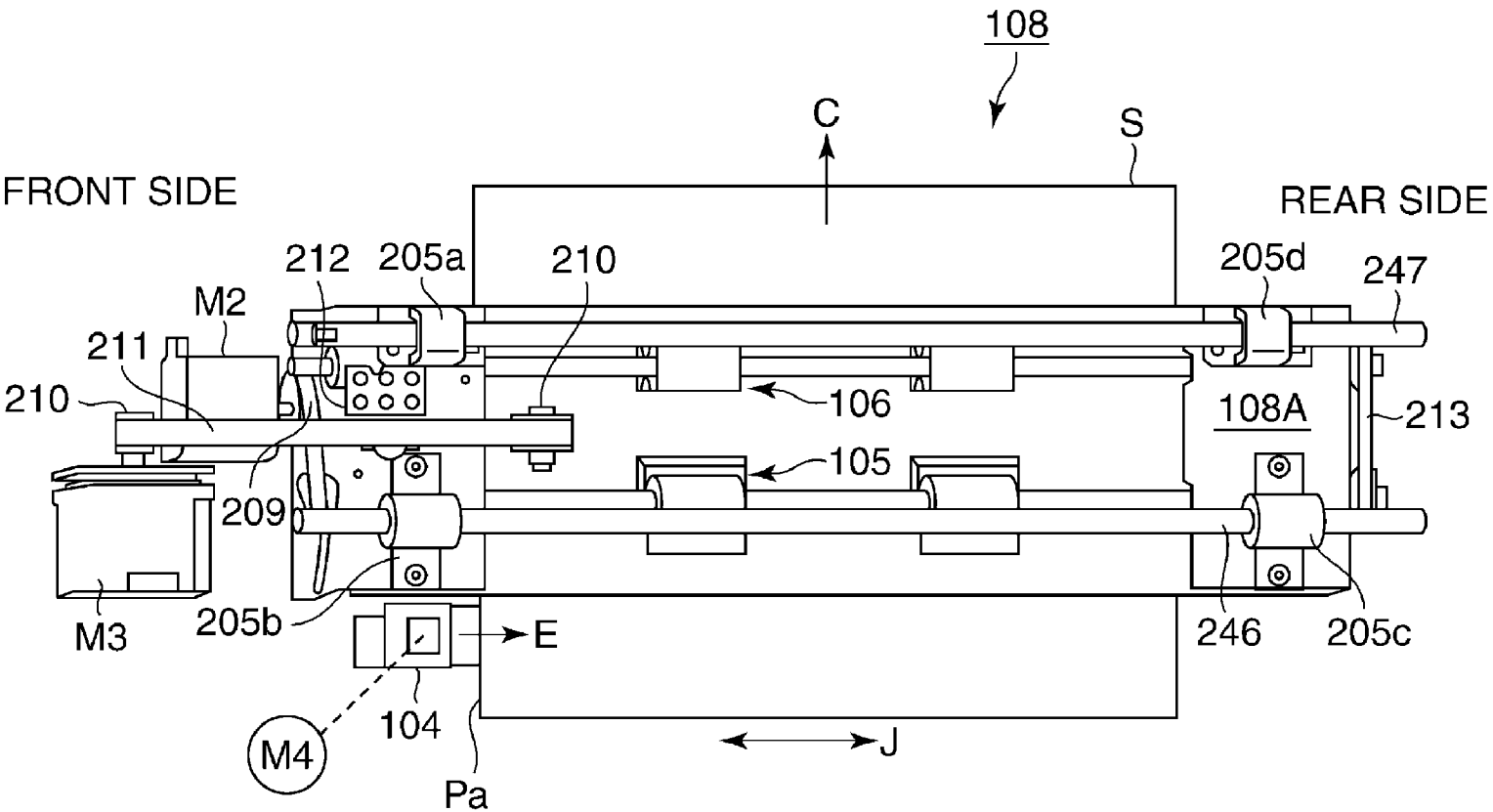
FIG. 4 is a view of the shift unit as viewed in a direction indicated by an arrow K in FIG. 3.

As shown in FIGS. 3 and 4, the shift unit 108 has a frame 108A. A conveying motor M2 and the two shift roller pairs 105 and 106 are mounted on the frame 108A. The conveying motor M2 causes rotation of the shift roller pair 105 via a drive belt 209 (see FIG. 4). The rotation of the shift roller pair 105 is transmitted to the shift roller pair 106 via a drive belt 213, whereby the shift roller pairs 105 and 106 rotate in unison with each other. When the shift roller pairs 105 and 106 are driven for normal rotation, a sheet S conveyed into the shift unit 108 is conveyed in a direction C indicated by an arrow C (i.e. in the downstream direction along the conveying path 103). On the other hand, when the shift roller pairs 105 and 106 are driven for reverse rotation, the sheet S conveyed into the shift unit 108 is conveyed in an opposite direction to the direction C (i.e. in the upstream direction along the conveying path 103). The shift roller pairs 105 and 106 and the conveying motor M2 function as a unit for conveying sheets upstream or downstream along the conveying path 103.

Further, the frame 108A has a plurality of slide bushes 205*a*, 205*b*, 205*c*, and 205*d* mounted thereon for having guide rails 246 and 247 extended therethrough. The guide rail 247 extends through the slide bushes 205*a* and 205*d*, and the guide rail 246 through the slide bushes 205*b* and 205*c*. The guide rails 246 and 247 extend parallel with each other in a direction J indicated by an arrow J in FIGS. 3 and 4, and the ends of the respective guide rails 246 and 247 are rigidly secured to a frame body (not shown) of the sheet processing apparatus 100. Thus, the frame 108A can reciprocate in the direction J while being guided by the guide rails 246 and 247. The direction J corresponds to the transverse direction orthogonal to the sheet conveying direction.

The movement of the frame 108A in the direction J is caused by a shift motor M3. More specifically, a drive belt 211 extend around pulleys 220 supported respectively on an output shaft of the shift motor M3 and the frame body of the sheet processing apparatus 100, and the frame 108A is secured to the drive belt 211 via a connecting member 212. With this construction, when the shift motor M3 is driven, the frame 108A is moved in the direction J in accordance with the motion of the drive belt 211. The movement of the frame 108A in the direction J is caused while the shift roller pairs 105 and 106 are nipping the sheet S.

The lateral displacement sensor 104 disposed upstream of the shift unit 108 is kept on standby at a predetermined position (home position). Then, when the sheet sensor 107 (see FIG. 2) disposed between the shift roller pairs 105 and 106 detects the sheet S, the lateral displacement sensor 104 is moved from its home position by a sensor moving motor M4 in a direction E indicated by an arrow E in FIG. 4. The direction E is identical to the direction J. Then, when the lateral displacement sensor 104 detects a side end (sheet end extending along the sheet conveying direction) of the sheet S, the movement of the lateral displacement sensor 104 is temporarily stopped. At this time, the distance of travel of the lateral displacement sensor 104 (i.e. the number of drive pulses of the sensor moving motor M4) is detected, and the amount of lateral displacement of the sheet S is calculated based on the sensed travel distance.

The shift unit 108 is moved in the direction J by a distance that offsets the detected amount of lateral displacement of the sheet S, whereby the sheet S is returned to the reference position on the conveying path 103. Thus, the lateral displacement of the sheet S is corrected.

The shift unit 108 also functions as an offset mechanism for moving each sheet S in the direction orthogonal to the conveying direction so as to stack one sheet S on another on the lower discharge tray 137 in a sorted state. When an offset mode is set, the shift unit 108 is moved in the direction J by a set offset amount by the shift motor M3. This causes lateral shift (offset) of a sheet S punched by the punching unit 150. The offset mode is a mode in which a sheet discharge position is laterally shifted on a job-by-job basis or whenever one set of sheets is output, so as to enable sheet sorting, and sheets are stacked e.g. on the lower discharge tray 137.

Figure 5:
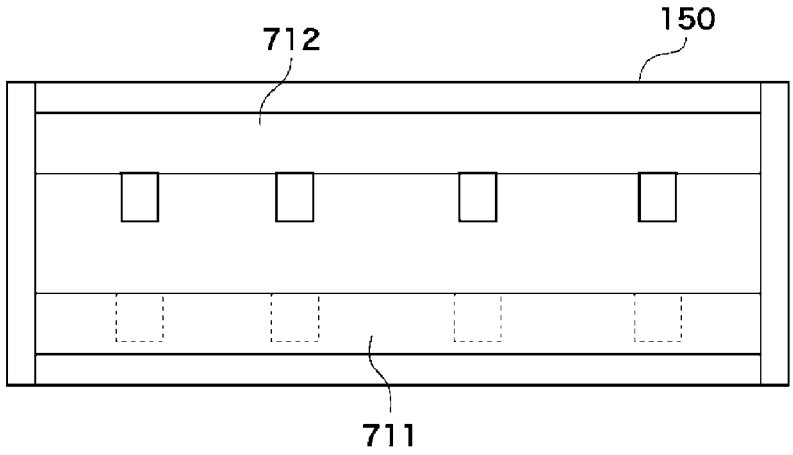
FIG. 5 is a view of a punching unit appearing in FIG. 2, as viewed from an upstream side of a sheet conveying path.
Figure 6:
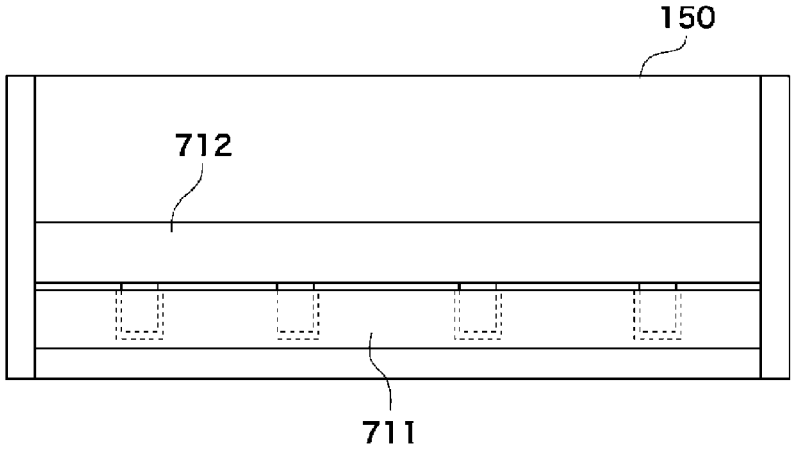
FIG. 6 is a view showing a status of the punching operation of the punching unit in FIG. 5.

Next, the construction of the punching unit 150 will be described with reference to FIGS. 5 and 6. FIG. 5 is a view of the punching unit 150 appearing in FIG. 2, as viewed from the upstream side of the conveying path 103. FIG. 6 is a view showing a status of the punching operation of the punching unit 150 in FIG. 5.

The punching unit 150 is rigidly secured on the frame body of the sheet processing apparatus 100 such that the lateral center of the punching unit 150 coincides with the central position of the conveying path 103. As shown in FIGS. 5 and 6, the punching unit 150 is provided with a punch 712 and a die 711 for simultaneously forming a plurality of holes arranged in the direction orthogonal to the sheet conveying direction. The punch 712 is moved to a position for mating engagement with the die 711 by a drive mechanism having a punch motor M5 (not shown in FIGS. 5 and 6) as a drive source (see FIG. 6). After having been moved to the position for mating engagement with the die 711, the punch 712 is returned to its former position (see FIG. 5).

By thus moving the punch 712 to the position for mating engagement with the die 711, a plurality of holes arranged in the direction orthogonal to the sheet conveying direction are formed in a sheet between the punch 712 and the die 711. The movement of the punch 712 is controlled based on a rotational speed of the punch motor M5 detected by a punch motor rotational speed sensor 713 (not shown in FIGS. 5 and 6).

Figure 7:
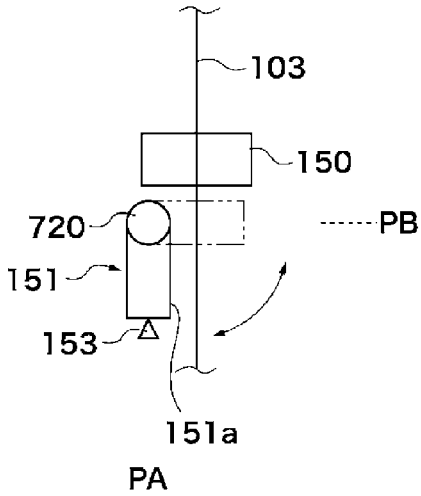
FIG. 7 is a schematic cross-sectional view of an abutment member appearing in FIG. 2 as viewed from an upstream side in a sheet conveying direction.

Next, the construction of the abutment member 151 will be described with reference to FIG. 7. FIG. 7 is a schematic cross-sectional view of the abutment member 151 as viewed from upstream in the sheet conveying direction.

As shown in FIG. 7, the abutment member 151 has an abutment surface 151*a* for abutment with the trailing end of a sheet. The abutment member 151 is attached to a rotating shaft 720 extending in a direction orthogonal to the conveying path 103. The rotating shaft 720 is rotatably supported on the frame body of the sheet processing apparatus 100 and is driven for rotation by an abutment motor M6 (not shown in FIG. 7). With this construction, the abutment member 151 is rotated about the rotating shaft 720 by the abutment motor M6 to be selectively moved to its retreat position PA and to its appearance position PB.

The retreat position PA is a position (home position) for retreat of the abutment member 151 from the conveying path 103. When the abutment member 151 is at its retreat position PA, the conveying path 103 is kept open such that a sheet can be conveyed. On the other hand, the appearance position PB is a position for appearance of the abutment member 151 on the conveying path 103. When the abutment member 151 is moved to its appearance position PB, the conveying path 103 is closed by the abutment member 151, whereby passage of a sheet is blocked. At this time, the abutment surface 151*a* of the abutment member 151 has projected on the conveying path 103 in orthogonal relation to the same.

Whether the abutment member 151 is at its retreat position PA is detected based on an output from a home position sensor (hereinafter abbreviated as "the HP sensor") 153. The HP sensor 153 is disposed such that it can detect the abutment member 151 when the abutment member 151 is at its retreat position PA. Control for moving the abutment member 151 from the retreat position PA to the appearance position PB or vice versa is performed based on the output (retreat position PA) from the HP sensor 153 and the number of drive pulses of the motor M6.

Next, a punching operation carried out using the punching unit 150 will be described with reference to FIGS. 8 to 11. Each of FIGS. 8 to 11 is a schematic view showing a status of sheet conveyance in a case where the sheet processing apparatus 100 according to the first embodiment performs punching, provided that sheet sorting is to be executed.

Figure 8:
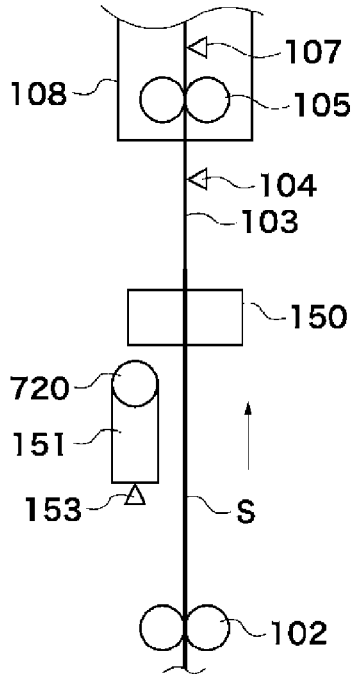
FIG. 8 is a schematic view showing a status of sheet conveyance in a case where the sheet processing apparatus according to the first embodiment performs punching, provided that sheet sorting is to be executed.

As shown in FIG. 8, a sheet S received from the copying machine 300 is conveyed toward the shift unit 108 along the conveying path 103 by the inlet roller pair 102. Then, the sheet S is guided into the shift unit 108 via the punching unit 150. The sheet S is nipped and conveyed by the shift roller pairs 105 and 106 of the shift unit 108. At this time, when the sheet sensor 107 detects the sheet S, movement of the lateral displacement sensor 104 is started, and when the lateral displacement sensor 104 detects the side end of the sheet S, the movement of the lateral displacement sensor 104 is stopped. Then, the amount of lateral displacement of the sheet S is detected based on the distance of travel of the lateral displacement sensor 104, and the shift unit 108 is moved in the distance J by a distance that offsets the detected lateral displacement amount. Thus, the lateral displacement of the sheet S is corrected.

After the correction of the lateral displacement of the sheet S, the sheet S is conveyed by the shift roller pairs 105 and 106 to a position where the trailing end of the sheet S passes through the punching unit 150. Time taken to convey a sheet S to the position where the trailing end thereof passes through the punching unit 150 after detection of the leading end of the sheet S by the sheet sensor 107 can be calculated based on the length of the sheet S in the sheet conveying direction, a conveying speed for conveying the sheet S, and the distance between the sheet sensor 107 and the punching unit 150. Information on the length of the sheet S in the sheet conveying direction has already been received from the controller 950. The sheet conveying speed and the distance between the sheet sensor 107 and the punching unit 150 are fixed values. Therefore, it is possible to determine, based on a time period having elapsed after a time point when the sheet sensor 107 detected a sheet S, whether or not the sheet S has been conveyed to the position where the trailing end thereof passes through the punching unit 150.

Figure 9:
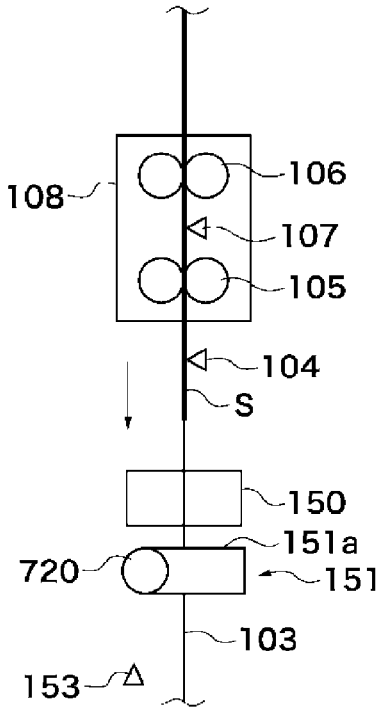
FIG. 9 is a schematic view showing another status of the sheet conveyance.

When the sheet S is conveyed to the position where the trailing end thereof passes through the punching unit 150, the abutment member 151 is moved from its retreat position PA to its appearance position PB as shown in FIG. 9. In timing synchronous with the movement of the abutment member 151, the shift roller pairs 105 and 106 are temporarily stopped and then reversely rotated by the conveying motor M2. As a consequence, the sheet S is conveyed not downstream along the conveying path 103, but in a direction opposite thereto, i.e. toward the punching unit 150 upstream along the conveying path 103. The reverse rotation of the shift roller pairs 105 and 106 is continued over a predetermined time period even after the trailing end of the sheet S (i.e. the leading end of the sheet S as viewed in the reverse conveying direction) has come into abutment with the abutment surface 151*a* of the abutment member 151.

Time taken for conveyance of the sheet S from the start of the reverse rotation of the shift roller pairs 105 and 106 to the abutment of the trailing end of the sheet S on the abutment surface 151*a* of the abutment member 151 can be calculated based on the length of the sheet S in the sheet conveying direction, a conveying speed for conveying the sheet S, and the distance between the punching unit 150 and the abutment member 151. Therefore, it is possible to obtain the amount of warpage of the sheet S after the abutment of the trailing end of the sheet S on the abutment surface 151*a* of the abutment member 151, based on a time period that has elapsed after the start of the reverse rotation of the shift roller pairs 105 and 106. The above-mentioned predetermined time period corresponds to driving time of the shift roller pairs 105 and 106 required to moderately warp the sheet S with the trailing end of the sheet S held in abutment with the abutment surface 151*a* of the abutment member 151.

Figure 10:
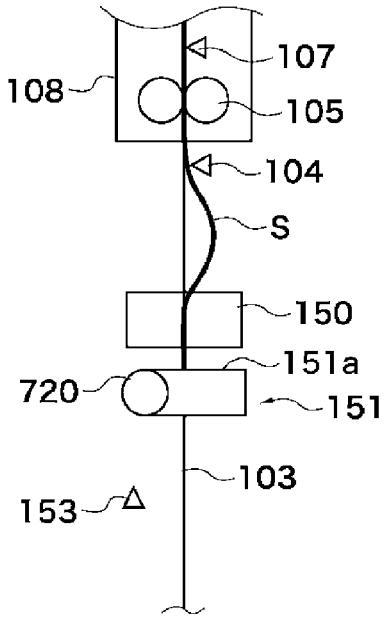
FIG. 10 is a schematic view showing another status of the sheet conveyance.

When the sheet S is further conveyed by the shift roller pairs 105 and 106 over the predetermined time period with the trailing end of the sheet S in abutment with the abutment member 151, the shift roller pairs 105 and 106 are stopped, whereby the conveyance of the sheet S is stopped. This causes the sheet S to become warped with its trailing end held in abutment with the abutment member 151, as shown in FIG. 10. More specifically, the trailing end of the sheet S is pressed against the abutment surface 151*a* of the abutment member 151, whereby skew of the trailing end of the sheet S is corrected. Then, the punching unit 150 punches holes in the skew-corrected trailing end-side portion of the sheet S.

Figure 11:
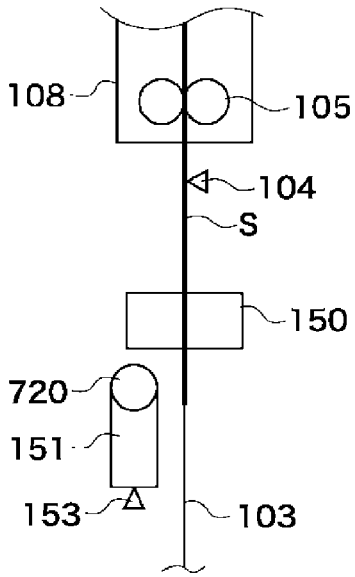
FIG. 11 is a schematic view showing another status of the sheet conveyance.

After completion of the punching of the sheet S, the abutment member 151 is moved from its appearance position PB to its retreat position PA as shown in FIG. 11. This releases the abutment between the trailing end of the sheet S and the abutment member 151 to separate the former from the latter. At the same time, the warpage of the sheet S is eliminated.

In a case where the offset mode for sheet sorting is set, the shift unit 108 is moved in the direction J by a set offset amount, with the shift roller pairs 105 and 106 nipping the sheet S. Thus, the sheet S is shifted (offset) for sorting. At this time, the trailing end of the sheet S is not in contact with the abutment member 151. Therefore, no frictional force is generated between the trailing end of the sheet S and the abutment member 151 during movement of the shift unit 108, which makes it possible to reduce load applied to the shift motor M3.

Then, the shift roller pairs 105 and 106 of the shift unit 108 are driven for normal rotation by the conveying motor M2, whereby the sheet S is conveyed toward the conveying roller 110 (i.e. downstream along the conveying path 103).

Figure 12:
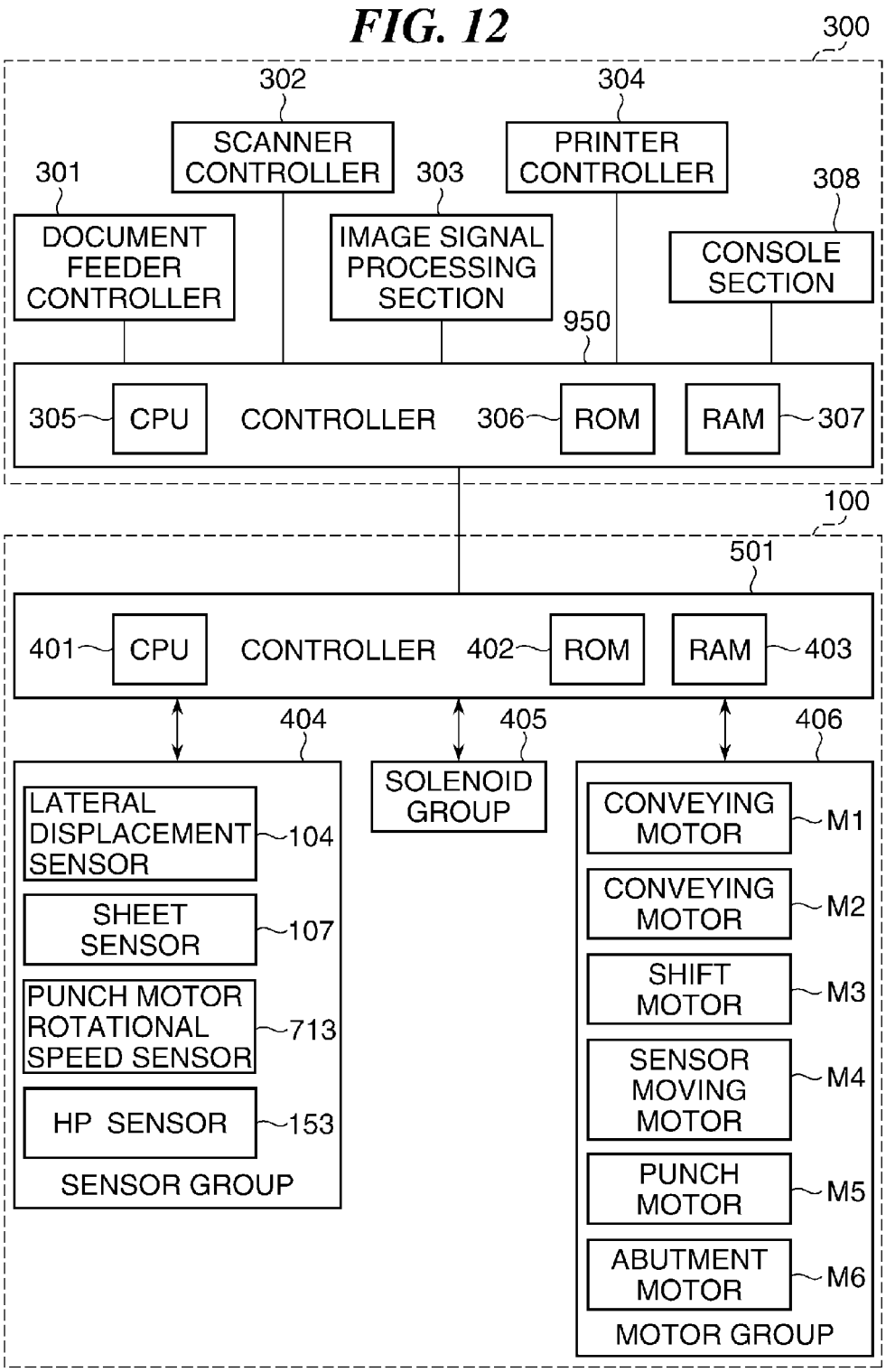
FIG. 12 is a block diagram of respective controllers of a copying machine and the sheet processing apparatus, appearing in FIG. 1.

Next, the configuration of control in the present embodiment will be described with reference to FIG. 12. FIG. 12 is a block diagram of the controller 950 of the copying machine 300 and a controller 501 of the sheet processing apparatus 100 appearing in FIG. 12.

As shown in FIG. 12, the controller 950 of the copying machine 300 includes a CPU 305, a ROM 306 which stores control programs executed by the CPU 305, and a RAM 307 which provides a work area for the CPU 305. A document feeder controller 301, a scanner controller 302, an image signal processing section 303, a printer controller 304, and an console section 308 are connected to the controller 950. Further, the controller 950 is provided with an interface, not shown, for connection to the controller 501 of the sheet processing apparatus 100, and the controller 950 and the controller 501 are communicably connected to each other via the above-mentioned interface. The CPU 305 of the controller 950 controls the above-mentioned blocks to carry out respective associated operations according to the control programs stored in the ROM 306.

The document feeder controller 301 controls the operation of the document feeder 500 (see FIG. 1) based on instructions from the controller 950. The scanner controller 302 controls the operation of the scanner 905 (see FIG. 1) based on instructions from the controller 950.

The image signal processing section 303 converts RGB analog image signals output from the scanner 905 into digital image signals based on instructions from the controller 950, and performs processing on each of the digital image signals. The digital image signals are converted into video signals and are delivered to the printer controller 304.

The printer controller 304 controls the operations of the respective image forming units 914*a* to 914*d*, the operation of the fixing device 904 (see FIG. 1), and so forth, based on instructions from the controller 950, so as to print out the video signals from the image signal processing section 303.

The console section 308 includes a plurality of keys for configuring various functions for image forming operation, and a display section for displaying information indicative of settings. A key signal associated with each key operation of the console section 308 is input to the controller 950. Further, on the display section of the console section 308 is displayed information, such as apparatus status information, set mode information, and warning information, output from the controller 950.

The controller 501 of the sheet processing apparatus 100 is incorporated in the sheet processing apparatus 100, and controls the operation of the sheet processing apparatus 100 based on instructions from the controller 950. The controller 501 includes a CPU 401, a ROM 402, and a RAM 403. The CPU 401 controls the operation of each solenoid of a solenoid group 405 and that of each motor of a motor group 406 according to control programs stored in the ROM 402, while monitoring output from each sensor of a sensor group 404. The RAM 403 provides a work area for the CPU 401.

The sensor group 404 includes a plurality of sensors, such as the lateral displacement sensor 104, the sheet sensor 107, the punch motor rotational speed sensor 713, and the HP sensor 153 for detecting the home position of the abutment member 151. The sensor group 404 further includes other sensors than these, but they are not shown in FIG. 12.

The solenoid group 405 includes solenoids (not shown) for causing respective operations of the flappers 114, 118, and 125.

The motor group 406 includes a conveying motor M1 for causing rotation of the inlet roller pair 102, the conveying roller 110, etc., and the conveying motor M2 and the shift motor M3 of the shift unit 108. Further, the motor group 406 includes the sensor moving motor M4 for moving the lateral displacement sensor 104, the punch motor M5 for driving the punching unit 150, and the abutment motor M6 for driving the abutment member 151. The other motors than these are not shown in FIG. 12.

Figure 13:
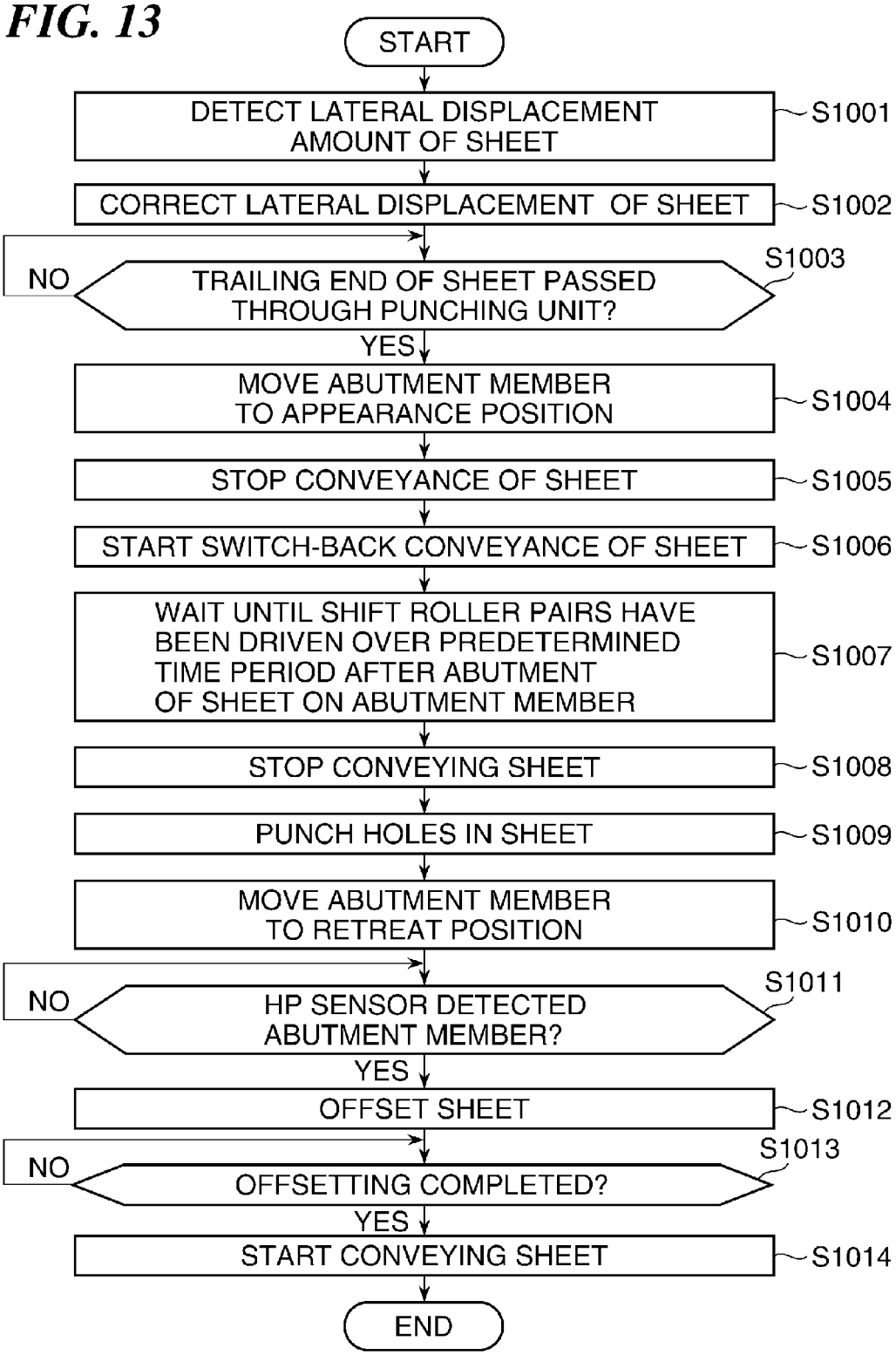
FIG. 13 is a flowchart of a control process executed by the controller of the sheet processing apparatus according to the first embodiment in a case where the sheet processing apparatus punches holes in a sheet and then sorts the punched sheet.

Next, a control process executed by the controller 501 in a case where holes are punched in a sheet and then the punched sheet is conveyed for sorting will be described with reference to FIG. 13. FIG. 13 is a flowchart of the control process executed by the controller 501 of the sheet processing apparatus 100 according to the first embodiment in the above-mentioned case where the sheet processing apparatus 100 punches holes in a sheet and then sorts the punched sheet. The process based on the flowchart in FIG. 13 is executed by the CPU 401 according to a program stored in the ROM 402 of the controller 501.

Now, it is assumed that a mode for punching holes in a sheet having an image formed thereon in the copying machine 300 and then sorting the sheet has been set, and the controller 501 performs control according to the set mode.

Upon reception of a sheet having an image formed thereon from the copying machine 300, the controller 501 (CPU 401) of the sheet processing apparatus 100 performs control such that conveyance of the sheet is started. This causes the sheet to be conveyed along the conveying path 103. Then, the sheet is guided into the shift unit 108 via the punching unit 150, and is conveyed while being nipped by the shift roller pairs 105 and 106 of the shift unit 108.

During this conveyance, when the sheet sensor 107 in the shift unit 108 detects the sheet, the controller 501 detects the amount of lateral displacement of the sheet (step S1001). In the step S1001, the lateral displacement sensor 104 is moved by the sensor moving motor M4 until the side end of the sheet is detected, and the amount of lateral displacement of the sheet is detected based on the distance of travel of the lateral displacement sensor 104. Then, the controller 501 causes the shift motor M3 to move the shift unit 108 in the direction J (i.e. the direction orthogonal to the sheet conveying direction) by a distance that offsets the detected lateral displacement amount, to thereby correct the lateral displacement of the sheet (step S1002). At this time, the shift roller pairs 105 and 106 of the shift unit 108 are nipping and conveying the sheet.

Then, the controller 501 awaits passage of the trailing end of the sheet through the punching unit 150 (step S1003). More specifically, the controller 501 waits for a time period that has elapsed after detection of the sheet (leading end thereof) by the sheet sensor 107 to reach a conveying time period required to convey the sheet until the trailing end of the sheet has passed through the punching unit 150.

When the trailing end of the sheet passes through the punching unit 150, the controller 501 causes the abutment motor M6 to move the abutment member 151 from its retreat position PA to its appearance position PB (step S1004). Then, the controller 501 temporarily stops the shift roller pairs 105 and 106 to stop conveyance of the sheet (step S1005). Thereafter, the controller 501 causes the conveying motor M2 to drive the shift roller pairs 105 and 106 for reverse rotation (step S1006). This conveys the sheet upstream toward the punching unit 150 along the conveying path 103.

Then, the controller 501 waits until the shift roller pairs 105 and 106 have been driven over a predetermined time period after abutment of the trailing end of the sheet on the abutment member 151 through the punching unit 150 (step S1007). More specifically, the controller 501 waits for a time period that has elapsed after the start of the reverse rotation of the shift roller pairs 105 and 106 to reach a time period required to cause the sheet to become moderately warped after abutment of the trailing end of the sheet on the abutment member 151.

When the shift roller pairs 105 and 106 are driven over the predetermined time period after abutment of the trailing end of the sheet on the abutment member 151, the controller 501 stops the shift roller pairs 105 and 106 to thereby stop the conveyance of the sheet (step S1008). Thus, skew of the trailing end of the sheet is corrected.

Then, the controller 501 causes the punching unit 150 to punch holes in the sheet (step S1009). In the step S1009, the punch motor M5 is actuated to move the punch 712 to the position for mating engagement with the die 711. Thereafter, the punch 712 is moved to its former position from the position for mating engagement with the die 711. Then, the controller 501 causes the abutment motor M6 to move the abutment member 151 from its appearance position PB to its retreat position PA (step S1010).

Then, the controller 501 waits for the HP sensor 153 to detect the abutment member 151 (step S1011). More specifically, the controller 501 awaits completion of the movement of the abutment member 151 to its retreat position PA. When the movement of the abutment member 151 to its retreat position PA is completed, the controller 501 causes the shift motor M3 to move the shift unit 108 in the direction 3 by the set offset amount to thereby perform offsetting for sheet sorting (step S1012). During the movement of the shift unit 108, the trailing end of the sheet is kept away from the abutment member 151. In place of starting the movement of the shift unit 108 based on an output from the HP sensor 153, it is possible to start the movement of the shift unit 108 when a time period required to eliminate the warpage of the sheet has elapsed after the start of driving of the abutment motor M6. It is assumed in this case that data on this time period is stored in the ROM 402 in advance.

Then, the controller 501 awaits completion of the offsetting by the shift unit 108 (step S1013). When the offsetting is completed, the controller 501 causes the conveying motor M2 to drive the shift roller pairs 105 and 106 for normal rotation to start conveyance of the sheet (step S1014). Thus, the sheet is conveyed toward the conveying roller 110.

Although in the present embodiment, conveyance of the sheet is started after completion of the movement of the shift unit 108 (i.e. the offsetting for sorting), conveyance of the sheet may be started by the shift roller pairs 105 and 106 before or upon the start of the movement of the shift unit 108 in the direction J so as to achieve higher productivity. Alternatively, conveyance of the sheet may be started in the middle of the movement of the shift unit 108 in the direction J.

When a separation operation for separating the abutment member 151 from the sheet is started, the frictional force between the abutment member 151 and the sheet becomes smaller than before the start of the separation operation. This means that even if the sheet processing apparatus starts a shift operation by the shift unit 108 in a state where the sheet and the abutment member 151 are not fully separated from each other, it is possible to produce an effect of reducing load applied to the shift motor M3. Therefore, the shift operation by the shift unit 108 may be started when a predetermined time period has elapsed after the start of the separation operation. The predetermined time period is set to be shorter than a time period taken from the start of the separation operation to completion of the same, and is regarded as a time period taken before the frictional force between the sheet and the abutment member 151 becomes negligible. It is also assumed in this case that the predetermined time period is stored in the ROM 402 in advance.

Figure 14:
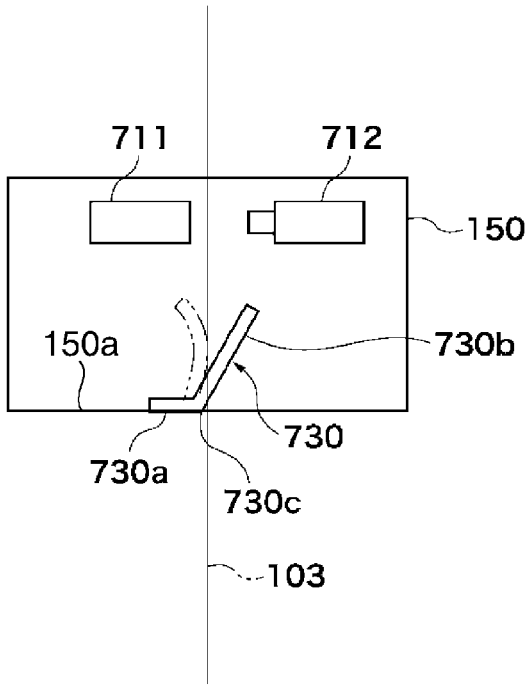
FIG. 14 is a schematic view of an abutment member provided in a sheet processing apparatus according to a second embodiment of the present invention.

Next, a second embodiment of the present invention will be described with reference to FIGS. 14 to 19. FIG. 14 is a schematic view of an abutment member provided in a sheet processing apparatus according to the second embodiment. Each of FIGS. 15 to 18 is a schematic view showing a status of sheet conveyance in a case where the sheet processing apparatus according to the second embodiment punches holes in a sheet and then sorts the punched sheet. FIG. 19 is a flowchart of a control process executed by the controller 501 in a case where the sheet processing apparatus according to the second embodiment executes a punching process for punching holes in a sheet and then sorting the punched sheet. The control process based on the flowchart in FIG. 19 is executed by the CPU 401 according to a program stored in the ROM 402 of the controller 501.

The present embodiment is distinguished from the above-described first embodiment only in that an abutment member is different in construction from the abutment member in the first embodiment, and is configured similarly to the first embodiment in the other respects. Therefore, members and blocks identical to those of the first embodiment are denoted by identical reference numerals, and description thereof is omitted.

In the present embodiment, the abutment member 730 is disposed in the punch unit 150 as shown in FIG. 14. The abutment member 730 is formed by a thin plate of an elastic material bent through approximately 110 degrees. The bending angle is not limited to 110 degrees, but it may be set to any angle within a range of 100 to 120 degrees. The bent abutment member 730 has one side portion 730*a* rigidly secured to a casing 150*a* of the punch unit 150 and the other side portion 730*b* obliquely projecting downstream in a manner closing the conveying path 103. The side portion 730*b* is elastically deformable from a boundary portion 730*c* between the side portions 730*a* and 730*b* (see two-dot chain lines in FIG. 14) in a retreat direction from the conveying path 103. The position of the boundary portion 730*c* is slightly offset from a position on the conveying path 103 so as to prevent a conveyed sheet S from colliding with the side portion 730*a*.

Figure 15:
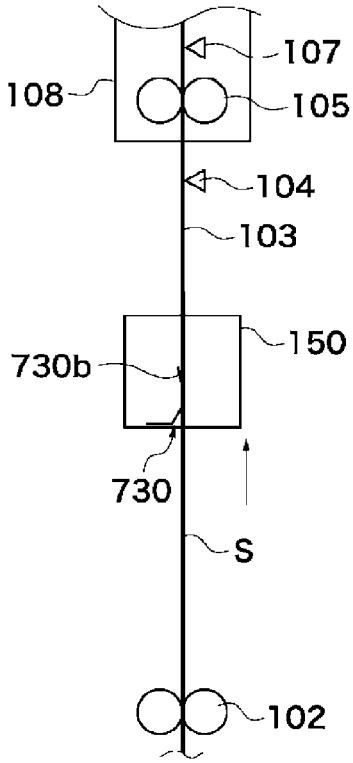
FIG. 15 is a schematic view showing a status of sheet conveyance in a case where the sheet processing apparatus according to the second embodiment punches holes in a sheet and then sorts the punched sheet.

In a case where the sheet S is conveyed from upstream toward the side portion 730*b*, the sheet S comes into contact with the side portion 730*b* and pushes the same aside as shown in FIG. 15. At this time, the side portion 730*b* is deformed from the boundary portion 730*c* between the side portions 730*a* and 730*b* to be retreated from the conveying path 103, and the sheet S is conveyed downstream along the conveying path 103 while passing by the side portion 730*b*. Then, when the trailing end of the sheet S has passed by the side portion 730*b*, the side portion 730*b* returns to its position for closing the conveying path 103.

Figure 16:
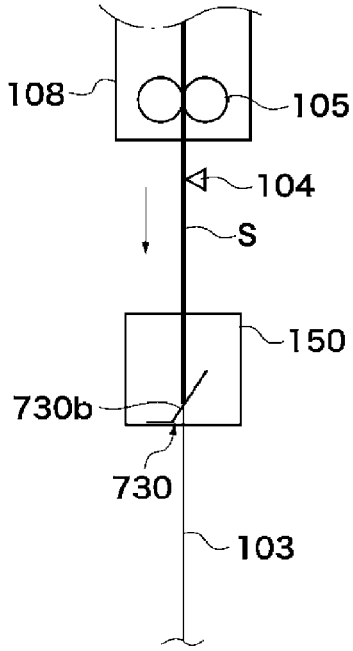
FIG. 16 is a schematic view showing another status of the sheet conveyance.
Figure 17:
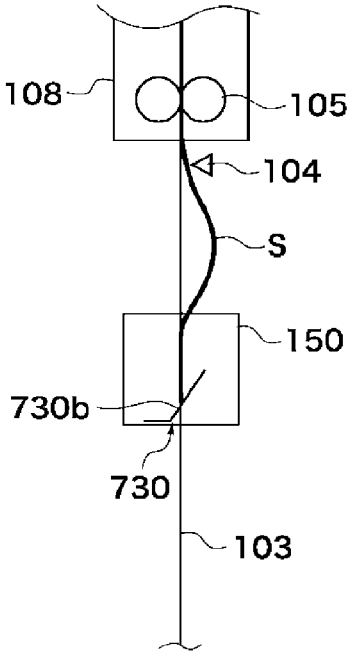
FIG. 17 is a schematic view showing another status of the sheet conveyance.

Then, the amount of lateral displacement of the sheet S is detected, and the lateral displacement of the sheet S is corrected by the shift unit 108 as in the first embodiment. After completion of the correction of the lateral displacement of the sheet S, the shift unit 108 conveys the sheet S upstream toward the punching unit 150. In this case, the trailing end of the sheet S comes into abutment with the side portion 730*b* projecting in a manner closing the conveying path 103 or the side portion 730*a*, as shown in FIG. 16, but the side portion 730*b* is hardly deformed. Then, when the sheet S is further conveyed over a predetermined time period with the trailing end thereof held in abutment with the side portion 730*b* or the side portion 730*a*, the trailing end of the sheet S is moderately warped as shown in FIG. 17. Thus, similarly to the abutment member 151 in the first embodiment, the abutment member 730 functions as a member for correcting skew of the trailing end side of a sheet, whereby skew of the trailing end side of the sheet S is corrected.

Figure 18:
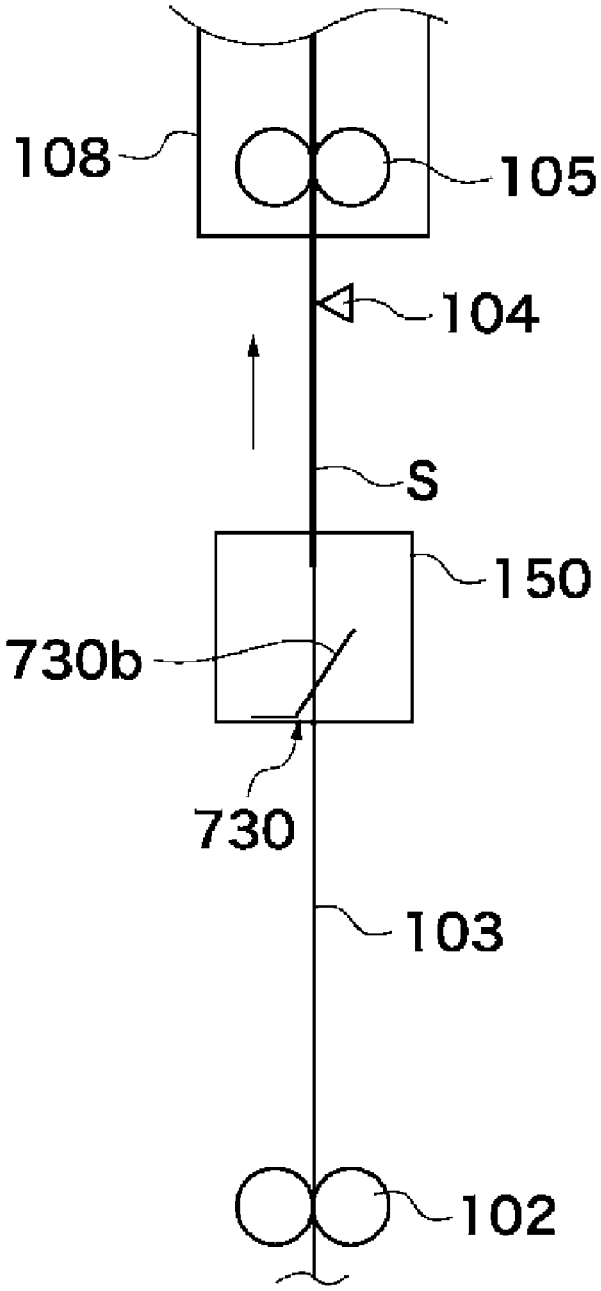
FIG. 18 is a schematic view showing another status of the sheet conveyance.
Figure 19:
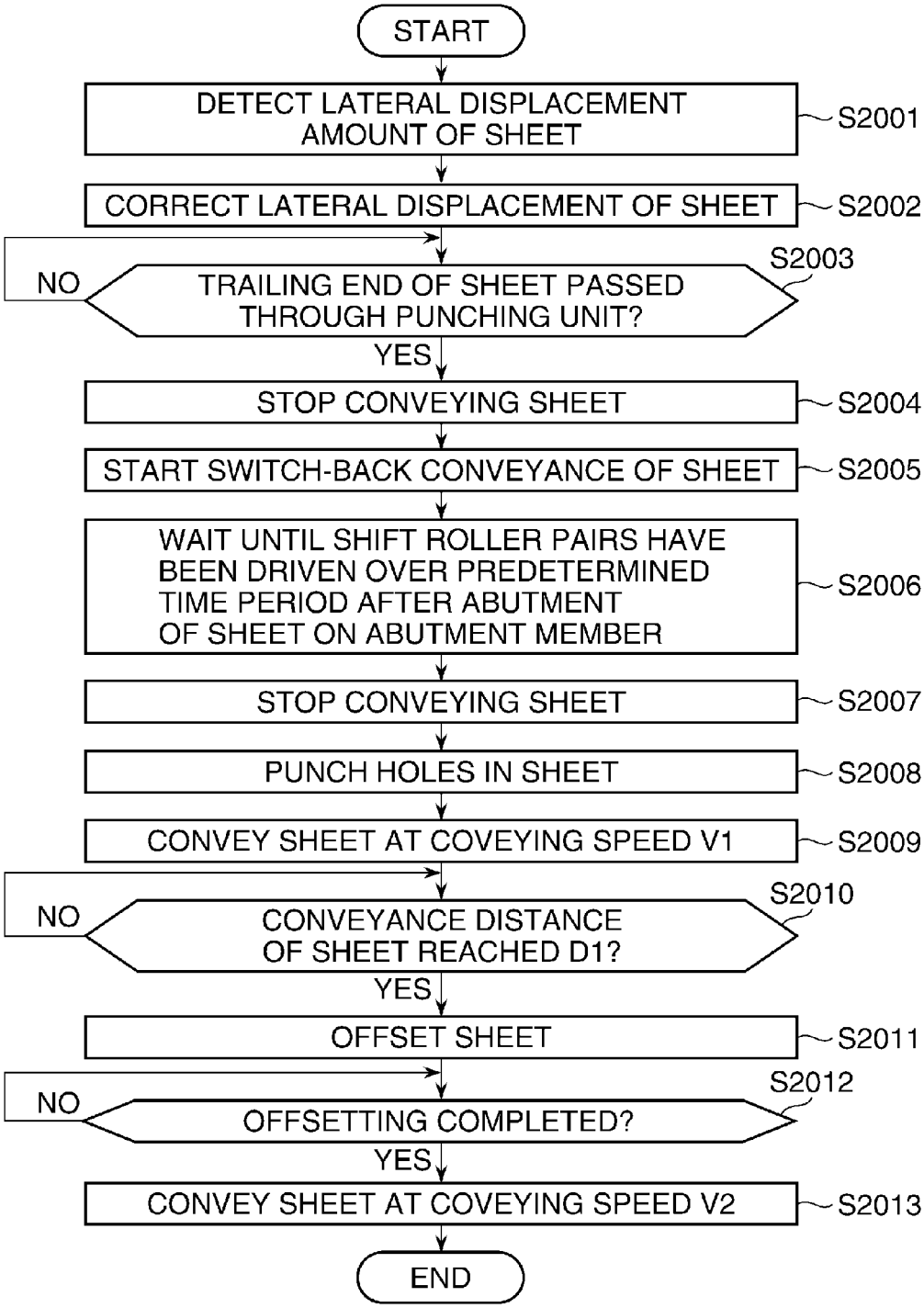
FIG. 19 is a flowchart of a control process executed by a controller of the sheet processing apparatus according to the second embodiment in a case where the sheet processing apparatus executes a punching process for punching holes in a sheet and then sorting the punched sheet.

After completion of the correction of the skew of the trailing end side of the sheet S, the sheet S is conveyed downstream along the conveying path 103 as shown in FIG. 18. In accordance with the downstream conveyance of the sheet S, the trailing end of the sheet S is separated from the side portion 730*b*, whereby the warpage of the sheet S is eliminated.

Next, a control process executed by the controller 501 in a case where holes are punched in a sheet and then the punched sheet is conveyed for sorting will be described with reference to FIG. 19. The control process based on the flowchart in FIG. 19 is executed by the CPU 401 according to a program stored in the ROM 402 of the controller 501.

Now, as in the first embodiment, it is assumed that the controller 501 performs control according to the mode for punching holes in a sheet having an image formed thereon in the copying machine 300 and then sorting the sheet.

A sheet received from the copying machine 300 is conveyed along the conveying path 103. Then, the sheet is guided into the shift unit 108 via the punching unit 150, and is conveyed while being nipped by the shift roller pairs 105 and 106 of the shift unit 108.

During this conveyance, when the sheet sensor 107 in the shift unit 108 detects the sheet, the controller 501 (CPU 401) detects the amount of lateral displacement of the sheet based on the distance of travel of the lateral displacement sensor 104 (step S2001). Then, the controller 501 causes the shift motor M3 to move the shift unit 108 in the direction J (i.e. the direction orthogonal to the sheet conveying direction) by a distance that offsets the detected lateral displacement amount, to thereby correct the lateral displacement of the sheet (step S2002).

Then, the controller 501 awaits passage of the trailing end of the sheet through the punching unit 150 (step S2003). When the trailing end of the sheet passes through the punching unit 150, the controller 501 temporarily stops the shift roller pairs 105 and 106 to stop conveyance of the sheet (step S2004). Thereafter, the controller 501 causes the conveying motor M2 to drive the shift roller pairs 105 and 106 for reverse rotation to thereby start switch-back conveyance of the sheet (step S2005). This conveys the sheet upstream toward the punching unit 150.

Then, the controller 501 waits until the shift roller pairs 105 and 106 have been driven over a predetermined time period after abutment of the trailing end of the sheet on the abutment member 730 through the punching unit 150 (step S2006). When the shift roller pairs 105 and 106 are driven over the predetermined time period after abutment of the trailing end of the sheet on the abutment member 730, the controller 501 stops the shift roller pairs 105 and 106 to thereby stop the conveyance of the sheet (step S2007). Thus, skew of the trailing end side of the sheet is corrected. Then, the controller 501 causes the punching unit 150 to punch holes in the sheet (step S2008).

Then, the controller 501 causes the conveying motor M2 to drive the shift roller pairs 105 and 106 for normal rotation to thereby start conveying the sheet at a conveying speed V1 (step S2009). It is assumed that the conveying speed V1 is set to a speed that makes it possible to complete offsetting by the shift unit 108 before the sheet reaches the conveying roller 110 which cannot be laterally moved (see FIG. 2). Assuming that a time period from completion of punching by the punching unit 150 to completion of offsetting by the shift unit 108 is represented by T1, and a time period taken before a sheet conveyed at the conveying speed V1 reaches the conveying roller 110 after completion of the punching is represented by T2, the following relationship is satisfied between the time period T1 and the time period T2:

$$T2-T1>0$$

Therefore, the conveying speed V1 is set to a value that satisfies the relationship. The reason why the conveying speed V1 is set is that in the second embodiment, timing in which the trailing end of a warped sheet S is separated from the abutment member delays in comparison with the separation timing in the first embodiment.

Then, the controller 501 waits until the distance of conveyance of the sheet at the conveying speed V1 reaches a preset conveyance distance D1 (step S2010). The distance of conveyance of the sheet at the conveying speed V1 is calculated based on the conveying speed V1 and a time period that has elapsed after the start of the conveyance of the sheet at the conveying speed V1. The preset conveyance distance D1 corresponds to a conveyance distance required to separate the trailing end of the warped sheet from the abutment member 730.

When the distance of conveyance of the sheet at the conveying speed V1 reaches the preset conveyance distance D1, the controller 501 causes the shift motor M3 to move the shift unit 108 in the direction J by a set offset amount to thereby perform offsetting for sheet sorting (S2011). Then, the controller 501 awaits completion of the offsetting by the shift unit 108 (step S2012).

When the offsetting by the shift unit 108 is completed, the controller 501 switches the sheet conveying speed of the shift roller pairs 105 and 106 from the conveying speed V1 to a conveying speed V2 and conveys the sheet at the conveying speed V2 (step S2013). The conveying speed V2 corresponds to a conveying speed in a case where offsetting is not performed by the shift unit 108, and is set to be higher than the conveying speed V1. The reason why the conveying speed V1 is switched to the conveying speed V2 is that the offsetting of the sheet is completed before the sheet reaches the conveying roller 110.

According to the present embodiment, after completion of punching of a sheet, the sheet is conveyed downstream at the conveying speed V1, and when the distance of conveyance of the sheet at the conveying speed V1 reaches the conveyance distance D1 set as a conveyance distance required to separate the trailing end of the sheet from the abutment member 730, offsetting by the shift unit 108 is started. This makes it possible to prevent frictional force from being generated between the trailing end of the sheet and the abutment member 730 during the offsetting, to thereby reduce load applied to the shift motor M3. Further, by setting the conveying speed in the offset mode to be lower than that in the non-offset mode, it is possible to prevent the leading end of the sheet from reaching the conveying roller 110 downstream before completion of the offsetting.

In the case where sheet conveyance is started before completion of movement of the shift unit 108 in the first embodiment, the method of switching between the conveying speed V1 and the conveying speed V2 may be employed as in the second embodiment.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims priority from Japanese Patent Application No. 2008-245984 filed Sep. 25, 2008, which is hereby incorporated by reference herein in its entirety.

What is claimed is:

1. A sheet processing apparatus comprising:

an abutment member configured to correct skew of a side of a sheet;

a conveying unit configured to convey the sheet toward said abutment member so as to bring the sheet into abutment with said abutment member;

a puncher configured to punch holes in the sheet in abutment with said abutment member;

a shift unit configured to shift the punched sheet that has been punched by said puncher in a direction intersecting with a conveying direction of said conveying unit; and a control unit configured to cause said shift unit to start shifting the sheet in response to separation between the punched sheet and said abutment member.

2. The sheet processing apparatus according to claim 1, further comprising a driving unit configured to cause said abutment member to appear on a sheet conveying path and retreat from the sheet conveying path, and wherein said conveying unit conveys the sheet toward said abutment member which is caused by said driving unit to appear on the sheet conveying path.

3. The sheet processing apparatus according to claim 1, wherein said conveying unit conveys the sheet toward said abutment member such that the sheet is bowed after the sheet comes into abutment with said abutment member.

4. The sheet processing apparatus according to claim 2, wherein said conveying unit conveys the sheet such that the sheet is bowed after the sheet comes into abutment with said abutment member.

5. The sheet processing apparatus according to claim 1, further comprising a release unit configured to move said abutment member to separate said abutment member from the punched sheet.

6. The sheet processing apparatus according to claim 2, wherein said conveying unit reverses the conveying direction after a trailing end of the sheet has passed by said abutment member, to thereby convey the sheet toward said abutment member, and wherein said driving unit moves said abutment member to an appearance position where said abutment member appears on the conveying path, such that the sheet conveyed toward said abutment member by said conveying unit comes into abutment with said abutment member.

7. The sheet processing apparatus according to claim 6, wherein after said puncher has punched holes in the sheet, said driving unit moves said abutment member to a retreat position where said abutment member is retreated from the conveying path, and separates said abutment member from the punched sheet.

8. The sheet processing apparatus according to claim 1, wherein said abutment member has an elastically deformable abutment portion projecting onto the conveying path, and said abutment portion is retreated from the conveying path by being elastically deformed by the sheet and projects onto the conveying path by returning to an original state thereof after the sheet passes by the abutment portion.

9. The sheet processing apparatus according to claim 1, wherein said conveying unit stops conveying the sheet after having further conveyed the sheet a predetermined time period after a time point when the sheet came into abutment with said abutment member.

10. A method of controlling a sheet processing apparatus including a conveying unit configured to convey a sheet, an abutment member configured to correct skew of the sheet, a punching unit configured to punch holes in the sheet, and a shift unit configured to shift the punched sheet in a direction intersecting with a conveying direction, comprising:

causing the conveying unit to convey the sheet toward the abutment member and bring the sheet into abutment with the abutment member so as to correct skew of the sheet;

causing the punching unit to punch holes in the sheet in abutment with the abutment member; and causing the shift unit to shift the punched sheet that has been punched by said puncher in the direction intersecting with the conveying direction of said conveying unit in response to separation between the punched sheet and the abutment member.

11. An image forming apparatus comprising:

an image forming unit configured to form an image on a sheet; and a sheet processing apparatus configured to perform post-processing on the sheet having the image formed thereon by said image forming unit, wherein said sheet processing apparatus comprises:

an abutment member configured to correct skew of a sheet;

a conveying unit configured to convey the sheet toward said abutment member so as to bring the sheet into abutment with said abutment member;

a puncher configured to punch holes in the sheet in abutment with said abutment member;

a shift unit configured to shift the punched sheet that has been punched by said puncher in a direction intersecting with a conveying direction of said conveying unit; and a control unit configured to cause said shift unit to start shifting the sheet in response to separation between the punched sheet and said abutment member.

12. A sheet processing apparatus comprising:

an abutment member configured to correct skew of a side of a sheet;

a conveying unit configured to convey the sheet toward said abutment member so as to bring the sheet into abutment with said abutment member;

a puncher configured to punch holes in the sheet in abutment with said abutment member;

a shift unit configured to shift the punched sheet that has been punched by said puncher in a direction intersecting with a conveying direction of said conveying unit; and a control unit configured to cause said shift unit to start shifting the sheet when a predetermined time period elapses after an operation for separating between the punched sheet and said abutment member is started.

* * * * *